United States Patent [19]

Yoshida et al.

[11] 4,444,430

[45] Apr. 24, 1984

[54] SEAT HAVING PNEUMATIC COMPONENT

[75] Inventors: Youki Yoshida, Yokosuka; Kenji Ichikawa, Yokohama, both of Japan

[73] Assignees: Nissan Motor Co., Ltd.; Ikeda Bussan Co., Ltd., both of Yokohama, Japan

[21] Appl. No.: 255,248

[22] Filed: Apr. 17, 1981

[51] Int. Cl.[3] ..... A47C 3/00

[52] U.S. Cl. ..... 297/284; 297/DIG. 3; 5/454

[58] Field of Search ..... 297/284, DIG. 3; 5/454, 5/453; 417/440

[56] References Cited

U.S. PATENT DOCUMENTS

| | | | |
|---|---|---|---|
| 795,108 | 7/1905 | Doellinger | 5/454 |
| 1,279,580 | 9/1918 | Peters | 417/440 |
| 3,533,113 | 10/1970 | Stamberger | 5/454 |
| 3,974,827 | 8/1976 | Bodeen | 297/284 |
| 4,048,684 | 9/1977 | Korner et al. | 5/453 |
| 4,149,285 | 4/1979 | Stanton | 5/453 |
| 4,190,286 | 2/1980 | Bentley | 5/454 |

FOREIGN PATENT DOCUMENTS

| | | | |
|---|---|---|---|
| 2155058 | 5/1973 | Fed. Rep. of Germany | 297/DIG. 3 |

*Primary Examiner*—Francis K. Zugel

*Attorney, Agent, or Firm*—Schwartz, Jeffery, Schwaab, Mack, Blumenthal & Koch

[57] ABSTRACT

A seat which has a pneumatic component. The pneumatic component is pressurized to a desired degree to conform the curvature and hardness of the surface of the seat to the preference of the seat occupant. The pressurization is carried out by manipulating a control mechanism which allows air into and release air from the pneumatic component.

8 Claims, 8 Drawing Figures

SEAT HAVING PNEUMATIC COMPONENT

BACKGROUND OF THE INVENTION

1. Field of the Invention

The present invention relates to a pneumatic seat, viz., a seat having a built-in pneumatic component, and a seat whose seat surface configuration and hardness are adjustably variable as desired.

2. Description of the Prior Art

Conventionally, seats for a vehicle have a seat portion and a seat back portion which have a surface configuration and hardness suitable for supporting a body of a seat occupant comfortably. However, such surface configuration and hardness are standarized, thus failing to meet varying demands by all possible seat occupants having different body configurations. Moreover, in view of personal preference and for the purpose of helping to eliminate fatigue it may sometimes be desirable to apply pressure to the lumbar portion of the occupant, causing that portion of a seat back which is adapted to support the lumbar portion of the seat occupant to protrude.

SUMMARY OF THE INVENTION

According to the present invention, a seat comprises a built-in pneumatic component, a built-in pneumatic supply and a control mechanism accessible to the seat occupant which is provided to control the pressure in the pneumatic component to provide the desired support of the seat occupant.

Accordingly, an object of the present invention is to provide a seat which provides the desired support of the seat occupant by adjustably varying the configuration and hardness of the seat.

BRIEF DESCRIPTION OF THE DRAWINGS

The present invention is further described in connection with the drawings, in which.

DETAILED DESCRIPTION OF THE INVENTION

Referring to FIGS. 1, 2, 7 and 8 of the drawings, the invention is embodied in a vehicle seat having a seat portion 10 and a seat back portion 12. The seat back portion 12 has a built-in elongate pneumatic component 14, in the form of an air bag type lumbar support, oriented horizontally and disposed at a location within a lower half area of the seat back portion 12 which is adapted to support the lumbar portion of the seat occupant.

Figure 1:
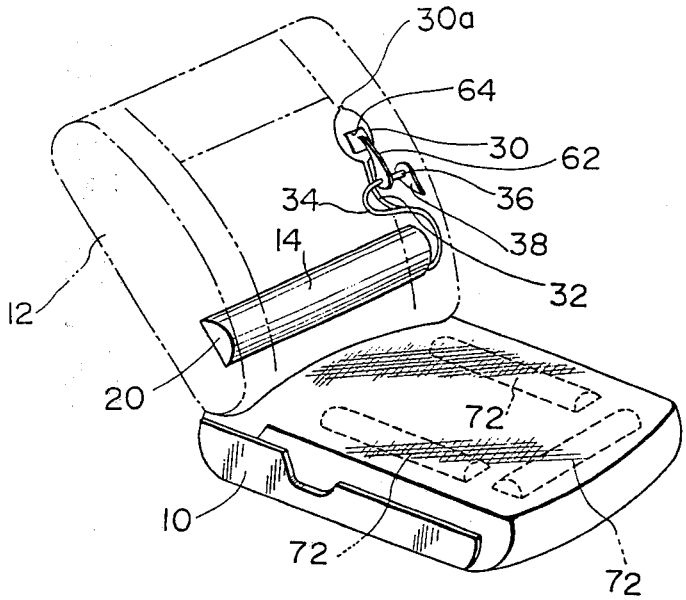
FIG. 1 is a perspective view of a seat having a built-in pneumatic component, in the form of an air lumbar support, a pneumatic supply in the form of an air pump and a control mechanism to pressurize the pneumatic component.
Figure 2:
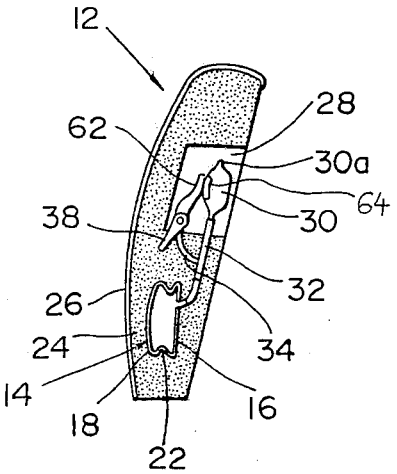
FIG. 2 is a longitudinal sectional view of a seat back portion of the seat shown in FIG. 1.

The pneumatic component 14 comprises a rigid base wall 16, a flexible elastomeric top wall 18 extending in opposed relationship with the rigid base wall 16 and fixed to both sides of the latter, and flexible elastomeric bellow like end walls 20, each interconnecting the end of the flexible elastomeric top wall 18 and the end of the rigid base wall 16. As shown in FIG. 2, a dent 22 is formed to surround the pneumatic component 14. The top wall 18 and end walls 20 are made of a rubber or a synthetic rubber. The base wall 16, top wall 18 and end walls 20 cooperate to define an inflatable bag. To expand the elastomeric top wall 18 so as to push up a pad 24 and an outer skin 26 (see FIG. 2) toward the occupant, air is forcibly fed into the interior of the pneumatic component 14.

The seat back 12 has an apertured space 28 recessed from the rear side of the seat back to receive an air pump 30 in the form of a rubber bag. The pump 30 is fixedly mounted to the space 28 and communicates with the pneumatic component 14 through a supply hose 32. An exhaust hose 34 branching off the supply hose 32 is coupled with, and thus communicates with, a hollow shaft 36 associated with a manual lever 38.

The hollow shaft 36 is supported by a bearing 40 fixed to the seat back 12. One end of the hollow shaft 36 is fixedly received in a bore 42 formed in a base portion 44 of the lever 38, while the opposite end thereof is coupled with the exhaust hose 34. Disposed between the end 46 of the hollow shaft 36 and a shoulder 48 formed in walls of the bore is a valve plate 50 which is adapted to be pressed by air pressure created within the hollow shaft 36 to sealably contact with the shoulder 48, thus preventing air from escaping. Extending axially and outwardly from the bore 42 is a manual button 52 which has a plunger 54 abutting with the valve plate 50. The manual button 52 is biased outwardly by the force of a resilient member in the form of a spring 56. The spring 56 is mounted within a reduced diameter outlet bore 58 and bears against a flange 60 of the manual button 52. Pressing the button 52 against the force of the spring 56 causes disengagement of the valve plate 50 from the shoulder 48, thus allowing air within the hollow shaft 36 to escape outwardly through a clearance between the valve plate 50 and shoulder 48 and through the reduced diameter outlet bore 58 (see FIGS. 7 and 8).

Figure 7:
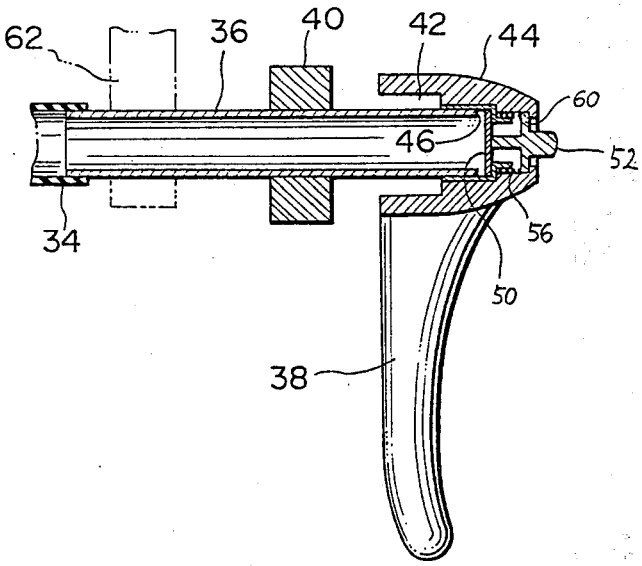
FIG. 7 is a cross sectional view of the control mechanism used in FIG. 1.
Figure 8:
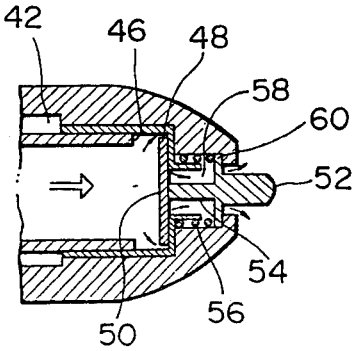
FIG. 8 is an enlarged fragmentary view of FIG. 7.

Referring to FIG. 7, an arm 62 has one end fixedly mounted to the hollow shaft 36 for integral rotation therewith. The opposite end of the arm 62 is in slideable contact with a plate 64 fixedly secured to the pump 30 (see FIG. 1). The pump 30 includes inlet check valve 30*a* to allow ambient air into the interior of the pump and an outlet check valve to allow the air into the supply hose 32.

With the structure as above, swingably moving the lever 38 through a certain limited angle causes expansion or contraction of the pump 30, thus forcible feeding air through the supply hose 32 to the pneumatic component 14. Therefore, the pneumatic component 14 is inflated to cause the flexible elastomeric top wall 18 to push up the pad 24 and skin 26 toward the occupant, thus helping to relieve the fatigue of the occupant because of the increased pressure applied to the lumbar portion of the body of the occupant. Where it is desired to lower the pressure within the pneumatic component 14, the manual button 52 is pressed to exhaust air. If the manual button 52 is pressed, the valve plate 50 is pressed to disengage from the shoulder 48, thus allowing air within the hollow shaft 36 to escape outwardly.

Figure 3:
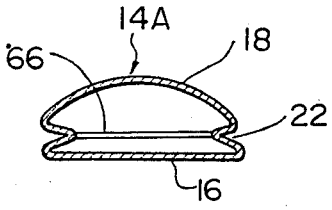
FIG. 3 is a cross sectional view of another embodiment of a pneumatic component.
Figure 4:
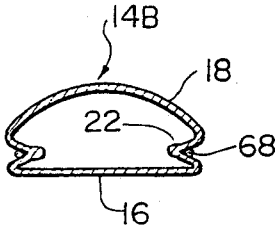
FIG. 4 is a similar view to FIG. 3 showing still another embodiment of a pneumatic component.

Referring to FIGS. 3 and 4, two alternative embodiments of a pneumatic component are described hereinafter.

Referring to FIG. 3, a pneumatic component which is now denoted by 14A has a partition wall 66 of a plate-like rubber therein. The partition wall 66 has its circumference fixedly attached to the inner wall of the pneumatic component 14A at a dent 22 of the pneumatic component 14A. The partition wall 66 may be a plurality of rubber strips or an apertured rubber plate. With this construction, since the partition wall 66 stretches as the pneumatic component 14A is inflated, it acts as means for restraining the deformation of the dent 22 of the pneumatic component 14A, and a strong restoring force is provided, thus allowing the pneumatic component 14A to restore to its original flattened state with a strong restoring force.

Alternatively to the use of the partition wall 66, a construction of a pneumatic component 14B as shown in FIG. 4 may be used wherein a spring wire 68 is disposed at a dent 22 to wind around the pneumatic component 14B. Alternatively, the same effect can be obtained if the thickness around a dent 22 is increased.

Figure 5:
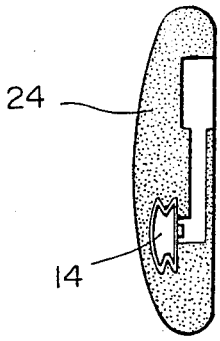
FIG. 5 is a similar view to FIG. 2 showing an integral seat back construction of a pad and a pneumatic component.
Figure 6:
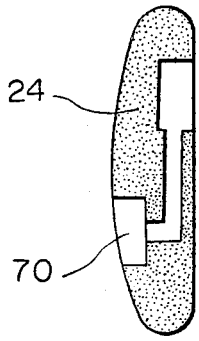
FIG. 6 is a similar view to FIG. 5 showing still another seat back construction.

Referring to FIGS. 5 and 6, the same reference numerals as used in FIG. 2 are used to designate like parts.

FIG. 5 shows an integral seat back construction of a pad 24 and a pneumatic component 14. In this Figure, a pneumatic component 14 is integrally formed within the pad 24. For forming the pneumatic component 14 integrally within the pad 24, the pneumatic component 14 is placed into a mold and urethane is formed around the pneumatic component 14 by injecting urethane upon forming the pad 24. This construction is advantageous in that relative movement of the pneumatic component 14 with respect to the pad 24 is prevented in use of the pneumatic component 14 and also in that it is suitable for mass production. The pad 24 is also formed with spaces for receiving a supply hose 32 and an air pump 30.

Referring to FIG. 6, a pad 24 has an apertured space 70 formed therein to receive a pneumatic component 14. With this construction, the pneumatic component 14 is able to directly push up a skin of the seat, making it easy to manipulate the lever with little force.

In the preceding description of the invention, the description has been centered on a seat having a single built-in pneumatic component, but the invention is not limited to this. As shown by phantom lines in FIG. 1, pneumatic components 72, similar to the pneumatic component 14, may be built in the desired portion of a seat to adjustably and independently vary the configuration and hardness of the seat by independently releasing air from the pneumatic component.

What is claimed is:

1. In a seat:

an air pump built into the seat;

a pneumatic component built into the seat, said pneumatic component communicating with said air pump to receive air under pressure and communicating with the ambient atmosphere;

valve means for controlling said communication of said pneumatic component with said ambient atmosphere, said valve means normally closing the communication of said pneumatic component with the ambient atmosphere, said valve means being manually operable to open said communication of said pneumatic component with the ambient atmosphere; and means for operating said air pump, said air pump operating means including, a shaft rotatably mounted within the seat, said shaft having two end portions;

an arm fixedly mounted to said shaft on one end portion thereof, said arm having one end in operative engagement with said air pump to operate said air pump; and a manual lever fixedly mounted to said shaft on the other end portion thereof, said manual lever being accessible from the outside of the seat, whereby movement of said manual lever causes movement of said arm to operate said pump.

2. In a seat as claimed in claim 1, wherein said pneumatic component comprises an inflatable bag which includes a rigid base wall, a flexible elastomeric top wall formed with a dent and flexible elastomeric bellows like end walls, said pneumatic component further comprising an apertured rubber wall fixedly attached to the inner wall of said inflatable bag at said dent and being stretchable as said inflatable bag is inflated, thus restraining the deformation of said dent and allowing said pneumatic component to restore to its original flattened state with a strong restoring force.

3. In a seat as claimed in claim 1, wherein said pneumatic component comprises an inflatable bag which includes a rigid base wall, a flexible elastomeric top wall formed with a dent and flexible elastomeric bellow like end walls, said pneumatic component further comprising a spring wire winding around said inflatable bag on said dent, thus restraining the deformation of said dent and allowing said inflatable bag to restore to its original flattened state with a strong restoring force.

4. In a seat as claimed in claim 3, wherein said pneumatic component is integrally formed with a pad of the seat.

5. In a seat as claimed in claim 3, wherein said pneumatic component is received in an apertured space formed in a pad of the seat.

6. In a seat as claimed in claim 3, wherein said air pump comprises a flexible member with a plate attached and said arm is positioned to contact said plate.

7. In a seat:

an air pump built into the seat;

a pneumatic component built into the seat, said pneumatic component communicating with said air pump to receive air under pressure;

a plate fixedly secured to said air pump;

a hollow shaft rotatably mounted within the seat, said hollow shaft having one end and an opposite end, said hollow shaft defining an axially extending bore;

an arm fixedly mounted on said hollow shaft on said one end thereof, said arm having one end adapted to engage said plate to press said air pump;

an exhaust hose having one end communicating with said pneumatic component and an opposite end coupled with said hollow shaft at said one end thereof to provide communication between the inside of the pneumatic component and said axially extending bore of said hollow shaft;

a manual lever fixedly mounted to said hollow shaft on said opposite end thereof, said manual lever having means defining a largest diameter bore section, a smallest diameter bore section and an intermediate diameter bore section having one end connected through a first shoulder with said largest diameter bore section and also connected through a second shoulder with said smallest diameter bore section;

said hollow shaft extending into said largest diameter bore section short of said first shoulder and fixedly secured therein;

a first valve plate movably disposed within said largest diameter bore section, said valve plate being responsive to air pressure within said axially extending bore of said hollow shaft to engage said first shoulder;

a manual button extending outwardly from said smallest diameter bore section, said manual button having a flange movably disposed in said intermediate diameter bore section and a plunger extending through said intermediate diameter bore section to abut with said valve plate; and spring means for biasing said flange against said second shoulder;

said valve plate being responsive to a pressure within said hollow shaft to engage said first shoulder to close fluid communication between said largest diameter bore section and said intermediate diameter bore section.

8. In a seat:

an air pump built into the seat;

a pneumatic component built into the seat, said pneumatic component communicating with said air pump to receive air under pressure;

a hollow shaft rotatably mounted within the seat, said hollow shaft having one end and an opposite end, said hollow shaft defining an axially extending bore;

an arm fixedly mounted to said hollow shaft, said arm operatively engaging said air pump;

an exhaust hose having one end communicating with said pneumatic component and an opposite end coupled with said hollow shaft at said one end thereof to provide communication between the inside of the pneumatic component and said axially extending bore of said hollow shaft;

a manual lever fixedly mounted to said hollow shaft on said opposite end thereof, said manual lever being accessible from the outside of the seat, said manual lever having means defining a bore communicating said opposite end of said axially extending bore of said hollow shaft with the ambient atmosphere; and an exhaust valve means mounted within said bore of said manual lever, said exhaust valve means normally closing the communication of said axially extending bore of said hollow shaft with the ambient atmosphere via said bore of said manual lever, said manual lever being manually operable to open said communication of said axially extending bore of said hollow shaft with the ambient atmosphere via said bore of said manual lever.

* * * * *